US005988901A

United States Patent [19]

Matsuura

[11] Patent Number: 5,988,901

[45] Date of Patent: Nov. 23, 1999

[54] RIBBON CASSETTE AND PANCAKE ACCOMMODATED IN THE RIBBON CASSETTE

[75] Inventor: Takanobu Matsuura, Iwate-ken, Japan

[73] Assignee: Alps Electric Co., Ltd., Japan

[21] Appl. No.: 09/173,494

[22] Filed: Oct. 15, 1998

[30] Foreign Application Priority Data

Oct. 27, 1997 [JP] Japan ..... 9-294401

[51] Int. Cl.[6] ..... B65H 75/00

[52] U.S. Cl. ..... 400/242; 400/247

[58] Field of Search ..... 400/242, 246, 400/247, 248

[56] References Cited

U.S. PATENT DOCUMENTS

| | | | |
|---|---|---|---|
| 3,679,039 | 7/1972 | Landgraf | 400/242 |
| 4,651,943 | 3/1987 | Kawaguchi | 400/242 |
| 4,684,272 | 8/1987 | Watanabe | 400/242 |
| 4,919,555 | 4/1990 | Kikuchi | 400/246 |
| 4,998,934 | 3/1991 | Taylor | 400/246 |
| 5,160,205 | 11/1992 | Mistyurik | 400/248 |
| 5,418,552 | 5/1995 | Maruyama | 400/248 |

FOREIGN PATENT DOCUMENTS

| | | | |
|---|---|---|---|
| 405286217 | 11/1993 | Japan | 400/242 |
| 7089198A | 4/1995 | Japan . | |
| 8310092A | 11/1996 | Japan . | |

*Primary Examiner*—Ren Yan
*Assistant Examiner*—Anthony H. Nguyen
*Attorney, Agent, or Firm*—Brinks Hofer Gilson & Lione

[57] ABSTRACT

A ribbon cassette which allows a precise recording operation to be achieved as a result of stably running an ink ribbon by preventing tilting or rattling of cores caused by tension produced in the ink ribbon during ink ribbon winding in order to stably rotate the cores; and a pancake which allows stable supply of ink ribbon by rotation of the cores. In the pancake, the cores have shaft-inserting holes, for inserting therein the supporting shafts which protrude beyond the carriage, formed in the central portion thereof, and annular grooves for fitting thereto driving power transmitting portions for transmitting rotational driving power of a take-up mechanism. The driving power transmitting portions are formed so as to protrude at the outer peripheral side of the corresponding supporting shafts.

6 Claims, 3 Drawing Sheets

RIBBON CASSETTE AND PANCAKE ACCOMMODATED IN THE RIBBON CASSETTE

BACKGROUND OF THE INVENTION

1. Field of the Invention

The present invention relates to a ribbon cassette used in a recording apparatus, such as a thermal transfer printer, and a pancake accommodated in such a ribbon cassette. More particularly, the present invention relates to a ribbon cassette which allows precise recording as a result of stably running an ink ribbon while reducing rattling and rocking of cores, and a pancake accommodated in such a ribbon cassette.

2. Description of the Related Art

In conventional thermal transfer printers, recording operations are performed by transferring ink from an ink ribbon onto a recording sheet as a result of heating a thermal head. The ends of the ink ribbon are mounted to a take-up core and a supply core of a rotatably supported ribbon cassette. The ink ribbon, itself, is wound upon the take-up core and the supply core of the ribbon cassette. Rotation of the cores causes the ink ribbon to be conveyed to a recording sheet, and heating of the thermal head, disposed at the carriage, causes a desired recording operation to be performed on the recording sheet.

FIG. 5 illustrates such a ribbon cassette 4 which is placed at a top surface 2 of a carriage 1. A recording operation is performed, while the ink ribbon 3 in the ribbon cassette 4 is being wound up by driving the carriage 1. The ribbon cassette 4 includes a pair of cores 6A and 6B, a pair of pinch rollers 7A and 7B, and a plurality of guide 3 rollers 8. The pair of cores 6A and 6B are rotatably supported at a top case portion (not shown) and a bottom case portion 5A of a planar and substantially rectangular cassette case 5. The pair of pinch rollers 7A and 7B are rotatably supported for peeling the ink ribbon 3. The plurality of rollers 8 are provided for preserving the path of winding of the ink ribbon 3.

The pair of cores 6A and 6B are substantially cylindrical in shape. The ink ribbon 3, being either a thermally sublimating or a thermally melting type ink ribbon, is wound from both ends thereof upon the outer peripheral surface of each of the cores 6A and 6B, whereby a pancake is formed. When the ribbon cassette 4 is carried by the carriage 1 of the printer being used, the core 6A engages a take-up bobbin 9, serving as take-up mechanism shown in FIG. 6, and winds up the portion of the ink ribbon 3 that has been subjected to a recording operation. On the other hand, the core 6B engages a supply bobbin (having the same form as the take-up bobbin 9) disposed at the carriage 1, and supplies the ink ribbon 3 for performing a recording operation onto a recording sheet.

Bobbin fitting holes 10A and 10B are formed in the inner peripheral surfaces of the cores 6A and 6B, respectively. They are formed for fitting therein the take-up bobbin 9 and the supply bobbin (having the same shape as the take-up bobbin 9), respectively. A plurality of engaging protrusions 11, which are spaced in a peripheral direction, are formed at the bobbin fitting holes 10A and 10B. When the ribbon cassette 4 is being carried by the carriage 1, the engaging protrusions 11 mesh with a plurality of engaging protrusions 12 that are spaced in a peripheral direction along the outer peripheral surfaces of the take-up bobbin 9 and the supply bobbin.

The take-up core 6A, through the portions where the engaging protrusions 11 and 12 mesh, obtains rotational driving power from the take-up bobbin 9, serving as take-up mechanism. After an unused portion of the ink ribbon 3, wound upon the supply core 6B, has been subjected to a recording operation by the heat generated by a thermal head (not shown), the portion of the ink ribbon 3, which has been subjected to the recording operation, is wound upon the outer peripheral surface of the take-up core 6A. When the carriage 1 moves forward while the thermal head is in press-contact with the platen through the ink ribbon 3 and the recording sheet that are disposed between the thermal head and the platen, the supply core 6B is driven by the tension produced in the ink ribbon 3 that is wound upon the outer periphery of the supply core 6B. While the supply core 6B is being driven, the ink ribbon 3 is supplied to the recording sheet.

However, the above-described conventional cassette 4 has the following problem. The take-up bobbin 9 and the supply bobbin (having the same form as the take-up bobbin 9) that are fitted, respectively, to the cores 6A and 6B of the ribbon cassette 4 rotate by rotationally driving take-up shafts 9A of FIG. 6. During rotation, the take-up bobbin 9 and the supply bobbin are supported by supporting shafts 13 that are fixed to a base portion (not shown) of the carriage. The supporting shafts 13, however, are thin, being only about 1.6 mm thick. Therefore, when, during winding of the ink ribbon 3, the supporting shafts 13, which cannot withstand the tension in the ink ribbon, tilt, the rotational centers of the cores 6A and 6B, which engage the take-up bobbin 9 and the supply bobbin, respectively, move, causing the cores 6A and 6B to rock. Consequently, the ink ribbon 3 cannot be stably wound, thereby preventing precise recording operations.

Between the supporting shafts 13 and the take-up shafts 9A are provided gaps for making them rotatable. Between the take-up shafts 9A and the cores 6A and 6B are provided gaps for allowing insertion of the take-up shafts 9A into the cores 6A and 6B and allowing engagement of the take-up shafts 9A and the cores 6A and 6B. This results in great rattling of the cores 6A and 6B, causing the ink ribbon 3 to run unstably during recording operations.

In order to increase recording quality, the ink ribbon 3 must be run stably and the winding load must be kept constant. It has been found out that these can be achieved by reducing tilting and rattling of the cores 6A and 6B.

SUMMARY OF THE INVENTION

Accordingly, it is an object of the present invention to provide a ribbon cassette which allows precise recording operations as a result of stably rotating the cores and thus stably running the ink ribbon, by preventing tilting and rattling of the cores, caused by tension produced in the ink ribbon when the ink ribbon is being wound up during carriage driving (or during recording operations); and to provide a pancake which allows the ink ribbon to be wound upon the cores and to stably supply the ink ribbon to a recording sheet as a result of rotation of the cores.

According to the present invention, it is possible to rotate the cores without rocking or rattling them, by inserting the supporting shafts into corresponding shaft holes that are larger than conventional shaft holes in order to support them.

In addition, according to the present invention, it is possible to rotate the cores without rocking or rattling them, during recording operations, so that ink ribbon, wound upon the outer periphery of the cores, can be stably supplied to a recording sheet.

DESCRIPTION OF THE PREFERRED EMBODIMENTS

A description will now be given of preferred embodiments of the present invention, with reference to FIGS. 1 to 4.

Figure 1:
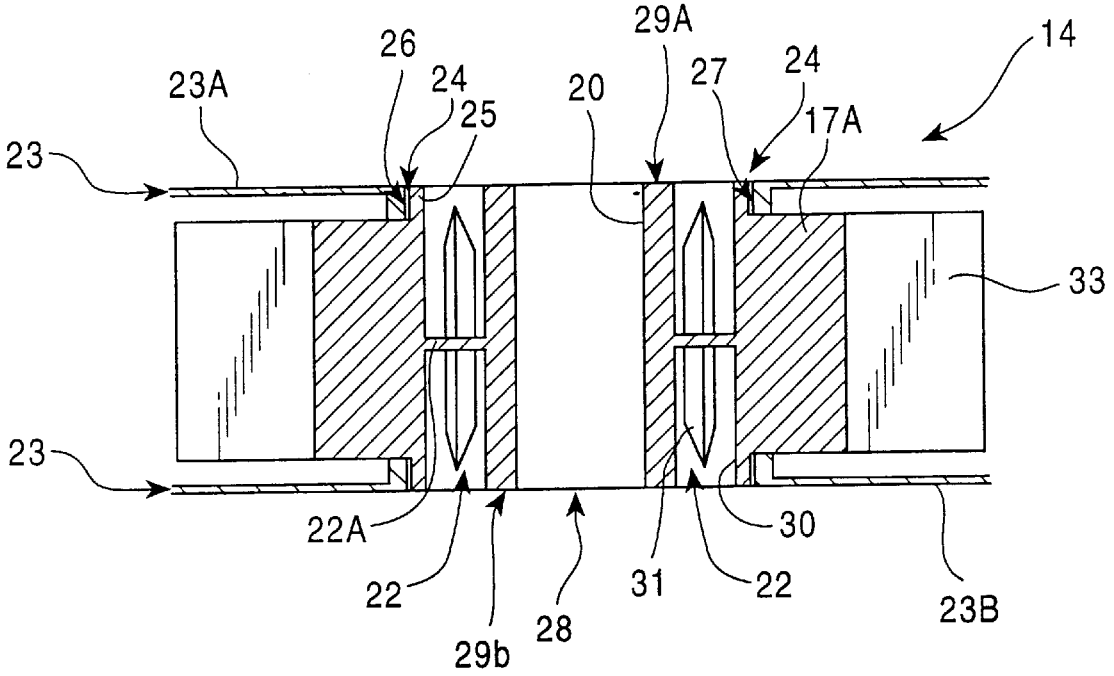
FIG. 1 illustrates an embodiment of the ribbon cassette in accordance with the present invention.
Figure 2:
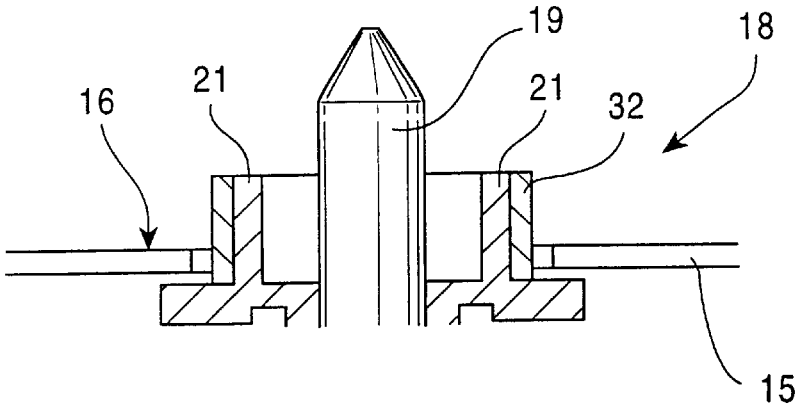
FIG. 2 illustrates a take-up mechanism, which engages the ribbon cassette, on a carriage, in an embodiment in accordance with the present invention.
Figure 3:
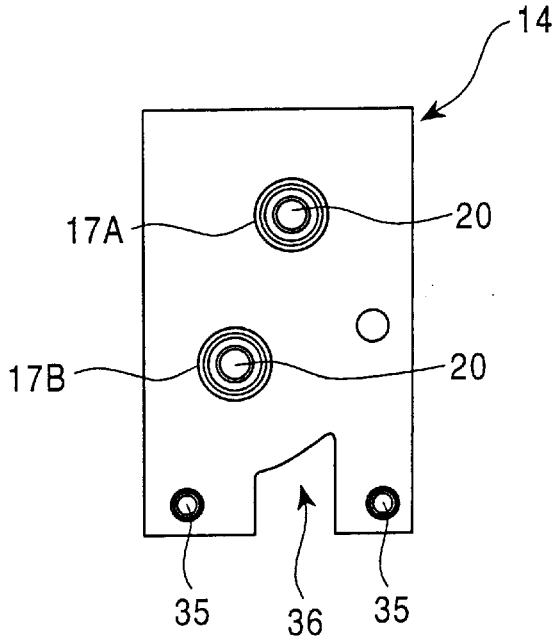
FIG. 3 is a plan view of the embodiment of the ribbon cassette in accordance with the present invention.

Before describing the preferred embodiments of the ribbon cassette 14 and the pancake of the present invention, a simple description will be given of the take-up mechanism 18 disposed at the carriage 15. The take-up mechanism 18 engages a take-up core 17A of the ribbon cassette 14, and causes an ink ribbon 33 to be wound upon the outer periphery of the core 17A and accommodated accordingly in the ribbon cassette 14. As shown in FIG. 2, the take-up mechanism 18 has at the center portion thereof a core supporting shaft 19. It causes the base portion (not shown) of the take-up mechanism 18 to be affixed to the carriage 15 and protrudes towards the side of the carriage 15 where the cassette 14 is mounted. The take-up core 17A (described later), which is loosely fitted onto the core supporting shaft 19, through a shaft-inserting hole 20, is rotatably supported. The supporting shaft 19, which has a diameter of about 4 mm, is larger than the conventional take-up bobbin 9 (serving as take-up mechanism), which has a diameter of 1.6 mm. Therefore, compared to the conventional case, the take-up core 17A rotates more stably, that is, the winding of the ink ribbon 33 can be steadily performed.

The take-up mechanism 18 has a substantially cylindrical carriage side driving power transmitting portion 21 that is provided at the outer peripheral side of the core supporting shaft 19 so as to protrude towards the cassette mounting side of the carriage 15. The take-up mechanism 18 engages a core side drive power transmitting portion 22 of the ribbon cassette 14 (described later) in order to transmit the driving power obtained from a driving motor (not shown) to the take-up core 17A of the ribbon cassette 14, causing the ink ribbon 33 to be wound upon the take-up core 17A.

A description will now be given of the ribbon cassette 14 that engages the take-up mechanism 18 disposed at the carriage 15, in accordance with the present invention.

The ribbon cassette 14 of the present embodiment engages the take-up mechanism 18, disposed at the top surface of the carriage 15, and obtains driving power from the take-up mechanism 18. The ribbon cassette 14 includes the take-up core 17A and a supply core 17B. After an unused portion of the ink ribbon 33, wound upon the supply core 17B, has been subjected to a recording operation as a result of heating the thermal head, the take-up core 17A winds up the portion of the ink ribbon 33 that has been subjected to the recording operation in the ribbon cassette 14. The supply core 17B engages a supply mechanism (having essentially the same structure as the take-up mechanism 18) in order to supply an unused portion of the ink ribbon 33, wound upon the outer periphery thereof, to a recording sheet.

The portion of the take-up core 17A formed in correspondence with the location of a circular hole 24, formed in the front and back surfaces 23A and 23B of a cassette case 23, protrude to about the same plane as the plane of the front and back surfaces 23A and 23B of the cassette case 23. When an outer peripheral edge of the protruding portion, or protrusion 25, is guided along the inner peripheral edge 26 of the circular hole 24, the rotational ends of the take-up core 17A (or both ends of the take-up core 17A in the direction of rotation) are supported.

The shaft-inserting hole 20 is formed in a center portion 28 of the take-up core 17A. It is loosely fitted onto the core supporting shaft 19 for rotationally supporting the take-up mechanism 18 disposed at the carriage 15 during cassette mounting. The take-up core 17A is rotatably supported, by making the take-up mechanism 18, during driving thereof, slidable and rotatable, with respect to the core supporting shaft 19 serving as supporting shaft. The inside diameter of the shaft-inserting hole 20 of the present embodiment is formed to about 4 mm in correspondence with the outer diameter (about 4 mm) of the core supporting shaft 19 of the take-up mechanism 18 that is inserted into the shaft-inserting hole 20. Since the core-supporting shaft 19, having a diameter that is more than twice that of conventional shafts, is inserted into the shaft-inserting hole 20, the take-up core 17A, during driving of the take-up mechanism 18, is supported such that it can rotate more stably than conventional take-up mechanisms, so that winding of the ink ribbon 33 can be achieved, without rocking of the core 17A and the ribbon cassette 14.

Outside surfaces 29A and 29B of the take-up core 17A are located on about the same plane as the front and back surfaces 23A and 23B of the cassette case 23, respectively, through the circular hole 24 in the cassette case 23. Along the outer peripheral side of the shaft-inserting hole 20, an annular core side driving power transmitting portion 22 is formed concentrically with the shaft-inserting hole 20 and in the form of a groove-shaped recess. A plurality of engaging protrusions 31 and 32 engage each other. The engaging protrusions 31 are spaced along an outer inside peripheral surface 30 of the core side driving power transmitting portion 22, in a peripheral direction thereof. The engaging protrusions 32 are spaced along an outer peripheral surface of the carriage side drive power transmitting portion 21. Engagement of the engaging protrusions 31 and 32 causes the rotational driving power obtained from the carriage side driving power transmitting portion 21 to be transmitted to the entire take-up core 17A.

The groove 22A of the core side drive power transmitting portion 22 is formed to a depth that allows the carriage side drive power transmitting portion 21, protruding from the ribbon cassette mounting surface 33 of the carriage 15, to be completely placed in the groove 22A.

The supply core 17B, provided at the supply side of the ink ribbon 33 in the ribbon cassette 14, has essentially the same form as the take-up core 17A. During the usual running of the ink ribbon 33 in the winding direction, the supply core 17B is driven and rotated as a result of being pulled by the tension produced in the ink ribbon 33 during driving of the take-up mechanism 18. When the ink ribbon 33 becomes loose during running thereof in the take-up path, a supply mechanism (not shown), with which the ink ribbon 33 engages, exerts back tension to the loose ink ribbon 33 in order to transmit driving power, without rocking of the ribbon cassette 14 during rotation of the supply core 17B in a direction opposite to the direction of rotation of the take-up core 17A.

A description will now be given of pancake 34 in accordance with the present invention.

Figure 4:
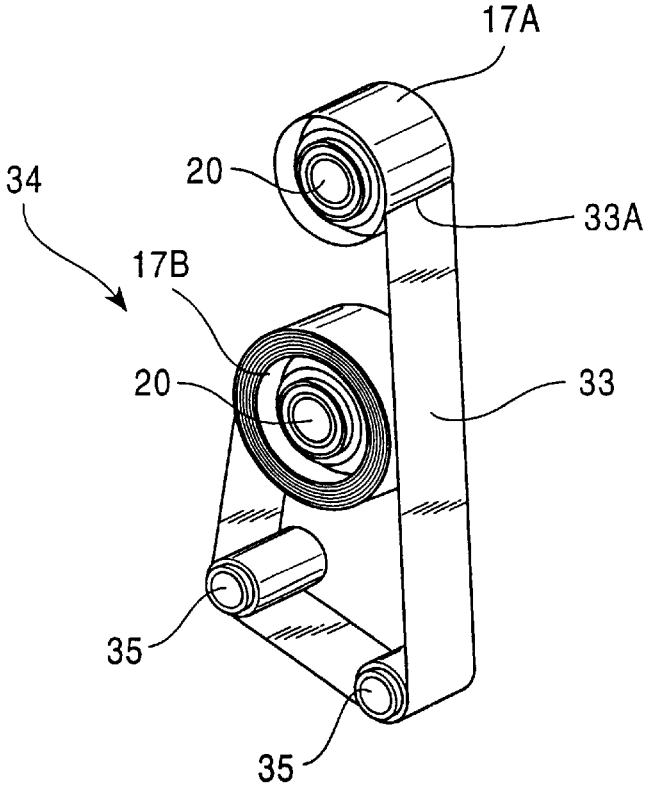
FIG. 4 illustrates an embodiment of the pancake in accordance with the present invention.
Figure 5:
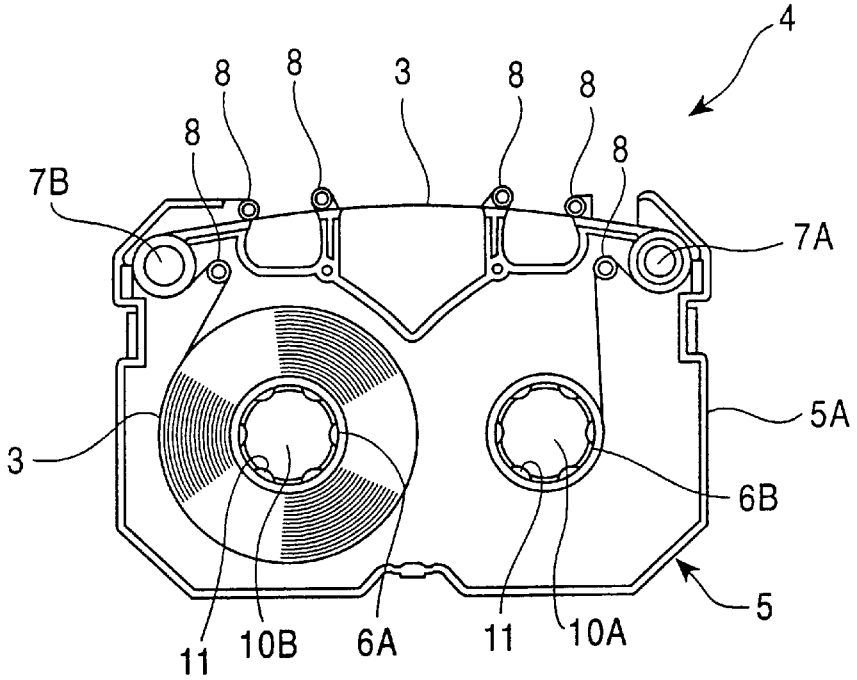
FIG. 5 PRIOR ART
FIG. 5 illustrates a conventional ribbon cassette.
Figure 6:
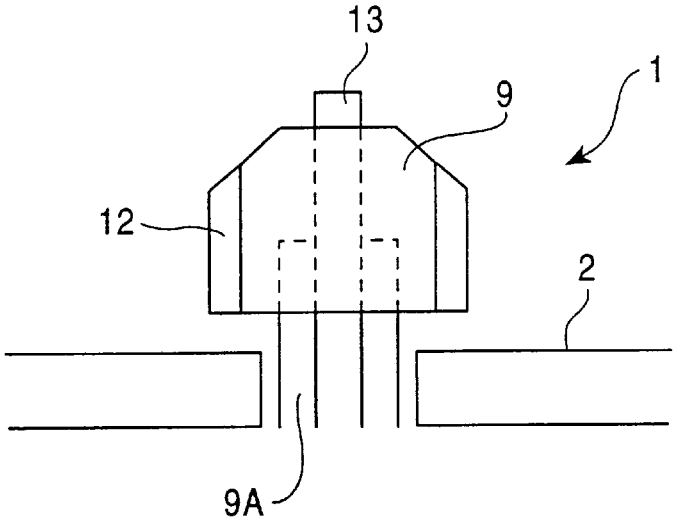
FIG. 6 PRIOR ART
FIG. 6 illustrates a conventional take-up bobbin, serving as a take-up mechanism.

In the pancake 34 of FIG. 4, a long ink ribbon 33, whose ink is transferred onto a recording sheet by heating a thermal head to perform a recording operation, is wound upon the outer peripheral surface of the supply core 17B such that its trailing end is adhered to the outer peripheral surface of the core 17B with an adhesive or the like. As mentioned above, the supply core 17B has essentially the same form as the core 17A. The take-up core 17A does not rock or rattle during winding of the ink ribbon 33 due to the structure consisting of the shaft-inserting hole 20 and the core side transmitting portion 22. The supply core 17B stably rotates as a result of tension produced in the ink ribbon 3 that is wound up by the take-up core 17A in order to supply the ink ribbon 33 to a recording sheet. It also engages a supply mechanism that provides back tension to the ink ribbon 33, when the ink ribbon 33, being wound up, becomes loose.

In the pancake 34, the ink ribbon 33 passes by a thermal head inserting portion 36 used for inserting therein a thermal head, serving as a recording portion of a printer, during mounting of a guiding member, such as a pin roller 35 in the cassette case 23, and used for mounting of the ribbon cassette 14 to the carriage 15. This results in a leading end portion 33A of the ink ribbon 33 being adhered to the outer peripheral surface of the take-up core 17A. Adhering the leading end portion 33A of the ink ribbon 33 to the outer peripheral surface of the take-up core 17A allows the ink ribbon 33 to be supplied to a recording sheet disposed near the thermal head inserting portion 36 as the take-up core 17A rotates. After the recording operation has been performed as a result of driving the thermal head, the portion of the ink ribbon 33 that has been subjected to the recording operation is wound upon the outer peripheral surface of the take-up core 17A and accommodated accordingly in the ribbon cassette 14. Here, the take-up core 17A and the supply core 17B have a supporting shaft inserting hole formed in the central portion thereof and an annular transmission groove formed at the outer peripheral side of the supporting shaft inserting hole associated thereto. By virtue of such a structure, the cores 17A and 17B can rotate without rocking or rattling, thereby allowing the pancake 34 to stably supply the ink ribbon 33 to a recording sheet.

A description will now be given of the operation of the ribbon cassette 14 and the pancake 34.

When the ribbon cassette 14, which accommodates therein the above-described pancake 34 including the above-described supply core 17B having ink ribbon 33 wound upon the outer peripheral surface thereof and the above-described take-up core 17A having the leading end portion 33A of the ink ribbon 33 adhered to the outer peripheral surface 17A thereof, is being mounted to the ribbon cassette mounting portion 17 of the cassette 15, the core supporting shafts 19 at the carriage are inserted into the supporting shaft inserting holes 20 formed in each of the cores 17A and 17B of the ribbon cassette 14. In addition, the driving power transmitting portions 21 having carriage 15 side engaging protrusions 32 provided thereat are mounted so as to engage the core side driving power transmitting portions 22 of the cores 17A and 17B (including engaging protrusions 31 at the outside inner peripheral surfaces 30).

The ribbon cassette 14 of the present embodiment may be used by reversing sides. The take-up core 17A engages the core supporting shaft 19 and the carriage side driving power transmitting portion 21 of the take-up mechanism 18 and winds up the portion of the ink ribbon 33 that has been subjected to a recording operation. On the other hand, the supply core 17B engages a supply mechanism (not shown) and is rotationally driven by the take-up mechanism 18 in order to supply an unused portion of the ink ribbon 33 to a recording sheet.

Here, the core supporting shafts 19 are inserted to the supporting shaft inserting holes 20 of the cores 17A and 17B of the ribbon cassette 14 that can be mounted to the carriage 15. Therefore, it is possible to wind up the ink ribbon 33 without causing the cores 17A and 17B and the ribbon cassette 14 to rock during driving of the take-up mechanism 18 as a result of more stably supporting the cores 17A and 17B during rotation thereof than the cores of conventional ribbon cassettes.

The core side driving power transmitting portions 22 engage the engaging protrusions 32 disposed at the carriage side driving power transmitting portions 21. As the take-up mechanism 18 is driven, the driving power, obtained from a drive motor (not shown) built in the carriage 15, causes the ink ribbon 33 to be wound up through the engagement.

Therefore, according to the embodiment of the present invention, the ink ribbon 33 can be stably run while preventing rocking or rattling of the cores 17A and 17B to stably supply it to a recording sheet.

The present invention is not limited to the above-described embodiments, so that various modifications can be made when necessary.

As can be understood from the foregoing description, according to the present invention, rotational power can be efficiently obtained from the carriage driving motor through the take-up mechanism, recording can be precisely performed by stably winding up the ink ribbon, etc.

What is claimed is:

1. A ribbon cassette for use with a thermal transfer printer, the thermal transfer printer having an ink ribbon take-up mechanism and an ink ribbon supply mechanism, the take-up mechanism and the supply mechanism each comprising a carriage, a supporting shaft protruding beyond the carriage, and a drive power transmitting portion associated with the supporting shaft of the take-up mechanism, the ribbon cassette comprising:

(a) a cassette case;

(b) a take-up core and a supply core, the cores spaced from each other, the cores rotatably supported at the cassette case, the take-up core having:

(i) an end;

(ii) a central portion, the central portion having a shaft-inserting hole formed therethrough, the shaft-inserting hole having an outer peripheral side, the hole adapted to receive one of the supporting shafts of the thermal transfer printer; and (iii) an annular transmitting groove, the annular transmitting groove at the outer peripheral side of the shaft-inserting hole, the annular transmitting groove adapted to engage and receive rotational power from one of the driving power transmitting portions of the thermal transfer printer when the associated supporting shaft is inserted into the shaft-inserting hole; and (c) an ink ribbon, the ink ribbon being wound upon the pair of cores from both ends thereof and being accommodated in the cassette case.

2. A ribbon cassette according to claim 1, wherein each of the annular transmitting grooves is formed to a depth which allows the associated driving power transmitting portion, protruding from the carriage, to be completely accommodated therein.

3. A ribbon cassette according to claim 2, wherein:

(a) the ribbon cassette has a front side and a back side;

(b) each of the cores has two ends; and (c) the annular transmitting groove is formed at both ends of each of the cores in order to allow the front side and the back side of the ribbon cassette to be mounted onto the carriage.

4. A cylindrical core for winding an ink ribbon thereon in a ribbon cassette associated with a thermal transfer printer, the thermal transfer printer having a carriage, a supporting shaft protruding from a top surface of the carriage, and a driving power transmitting portion formed at an outer periphery of the supporting shaft, the cylindrical core comprising:

(a) a center portion, the center portion having a shaft-inserting hole formed therethrough, the shaft-inserting hole adapted to receive the shaft of the thermal transfer printer, and (b) an annular transmitting groove formed outwardly of and concentrically with the shaft-inserting hole, the annular transmitting groove having an engaging protrusion adapted to engage the driving power transmitting portion of the thermal transfer printer, wherein the annular transmitting groove is adapted to receive rotational power from the driving power transmitting portion when the shaft is inserted into the shaft-inserting hole.

5. A cylindrical core according to claim 4, wherein each of the annular transmitting grooves is formed to a depth which allows the associated driving power transmitting portion, protruding from the carriage, to be completely accommodated therein.

6. In combination:

(a) an ink ribbon take-up mechanism to be used in a thermal transfer printer, the ink ribbon take-up mechanism comprising:

(i) a carriage, (ii) a supporting shaft, the supporting shaft having an outer peripheral side, the supporting shaft protruding beyond the carriage, and (iii) a driving power transmitting portion, the driving power transmitting portion protruding beyond the supporting shaft;

(b) an ink ribbon supply mechanism mounted on said carriage to be used in a thermal transfer printer, the ink ribbon supply mechanism comprising:

(i) a supporting shaft, the supporting shaft having an outer peripheral side, the supporting shaft protruding beyond the carriage, and (ii) a driving power transmitting portion, the driving power transmitting portion protruding beyond the supporting shaft; and (c) a ribbon cassette, the ribbon cassette comprising:

(i) a cassette case;

(ii) a take-up core and a supply core, the cores spaced from each other, the cores rotatably supported at the cassette case, the take-up core having:

(A) an end;

(B) a central portion, the central portion having a shaft-inserting hole formed therethrough, the shaft-inserting hole having an outer peripheral side, the shaft-inserting hole adapted to receive one of the supporting shafts of the thermal transfer printer; and (C) an annular transmitting groove, the annular transmitting groove at the outer peripheral side of the shaft-inserting hole, the annular transmitting groove adapted to engage and receive rotational power from one of the driving power transmitting portions of the thermal transfer printer when the associated supporting shaft is inserted into the shaft-inserting hole; and (iii) an ink ribbon, the ink ribbon being wound upon the pair of cores from both ends thereof and being accommodated in the cassette case.

* * * * *